US005709188A

United States Patent [19]

Al-Qutub

[11] Patent Number: 5,709,188

[45] Date of Patent: Jan. 20, 1998

[54] HEAT ENGINE

[76] Inventor: Amro Al-Qutub, P.O. Box 913, Dhahran, Saudi Arabia

[21] Appl. No.: 442,500

[22] Filed: May 16, 1995

Related U.S. Application Data

[63] Continuation-in-part of Ser. No. 163,724, Dec. 9, 1993, abandoned.

[51] Int. Cl.[6] ..... F02G 3/00

[52] U.S. Cl. ..... 123/204; 123/236; 418/260

[58] Field of Search ..... 60/39.281; 123/204, 123/236; 418/260, 261, 262, 263, 264

[56] References Cited

U.S. PATENT DOCUMENTS

| | | |
|---|---|---|
| 1,042,596 | 10/1912 | Pearson . |
| 1,138,481 | 5/1915 | Hupe . |
| 1,324,260 | 12/1919 | Meyer . |
| 2,382,259 | 8/1945 | Rohr . |
| 2,435,476 | 2/1948 | Summers . |
| 2,782,596 | 2/1957 | Lindhagen et al. . |
| 3,989,011 | 11/1976 | Takahashi . |
| 4,134,258 | 1/1979 | Hobo et al. . |
| 4,336,686 | 6/1982 | Porter . |
| 4,389,173 | 6/1983 | Kite . |
| 4,864,814 | 9/1989 | Albert . |
| 4,912,642 | 3/1990 | Larsen et al. . |
| 5,165,238 | 11/1992 | Paul et al. . |

FOREIGN PATENT DOCUMENTS

| | | | |
|---|---|---|---|
| 1815711 | 6/1970 | Germany | 123/204 |
| 40 23 299 | 2/1991 | Germany | 123/204 |
| 55-78188 | 6/1980 | Japan . | |
| 56-113087 | 9/1981 | Japan . | |

*Primary Examiner*—Michael Koczo
*Attorney, Agent, or Firm*—Richard C. Litman

[57] ABSTRACT

A rotary vane combustion engine, having a compressor, a combustion chamber, an expander, sensors for sensing critical conditions, and a microprocessor for controlling the engine responsive to sensed conditions. Projection of vanes from the compressor or expander rotor is controlled by arms which include bearings riding in a cam or track formed in the compressor or expander housing. The track maintains a predetermined gap between the vanes and the respective housings, thereby reducing the friction between vane and housing and the possibility of binding of a vane against the housing. Valves vent the expander to the atmosphere and allow the expansion ratio of the expander to be controllably varied. These valves are controlled by the microprocessor.

19 Claims, 4 Drawing Sheets

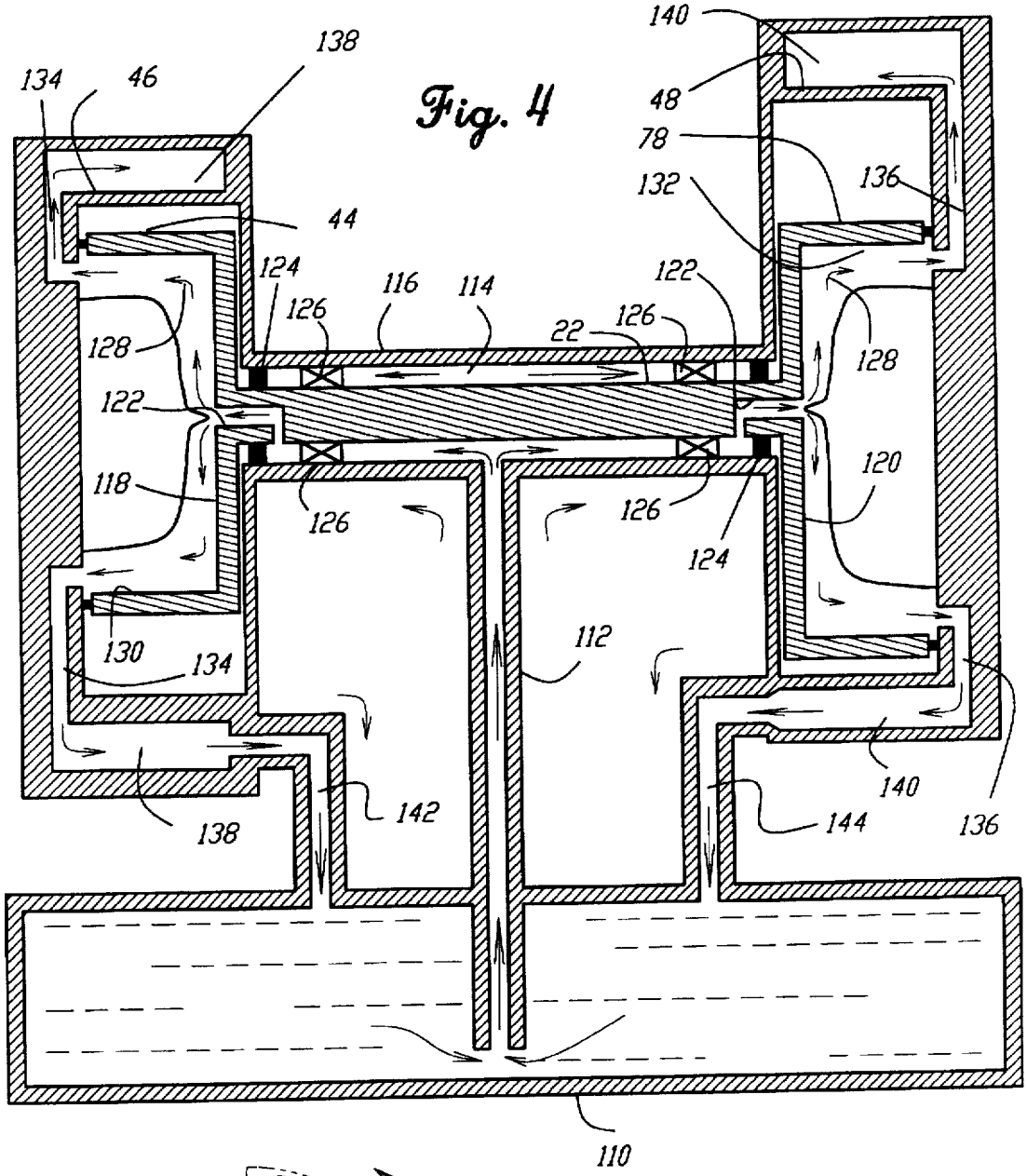
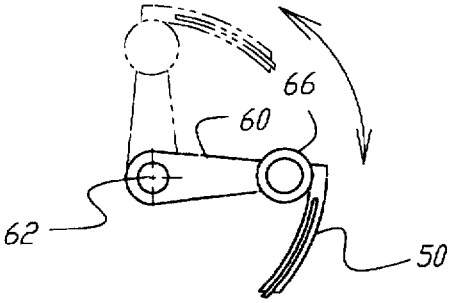
Fig. 5

HEAT ENGINE

This application is a continuation-in-part of application Ser. No. 08/163,724, filed on Dec. 9, 1993, now abandoned.

BACKGROUND OF THE INVENTION

1. Field of the Invention

The present invention relates to a heat driven combustion engine incorporating an air compressor, a combustion chamber, and an expansion chamber.

2. Description of the Prior Art

U.S. Pat. No. 5,165,238, issued to Marius A. Paul et al. on Nov. 24, 1992, discloses a combustion engine employing a Wankel type rotor and housing in the capacity of both compressor and expander.

U.S. Pat. No. 4,912,642, issued to Hals N. Larsen et al. on Mar. 27, 1990, shows an electronic engine control system. Larsen et al. does not show an expander having a selectable expansion ratio.

U.S. Pat. No. 4,864,814, issued to Albert F. Albert on Sep. 12, 1989, discloses a continuous combustion engine having reciprocating pistons which move radially outwardly from the axis of the combustion chamber. The output of these pistons is captured by respective crankshafts located still further outwardly from the axis.

U.S. Pat. No. 4,389,173, issued to William C. Kite on Jun. 21, 1983, shows a rotary internal combustion engine having a rotor with pivoted vanes. Kite does not show an engine having a separate compressor and expander. Further, Kite does not show an expander having a selectable expansion ratio.

U.S. Pat. No. 4,336,686, issued to Kenneth W. Porter on Jun. 29, 1982, shows a rotary vane or piston engine. The rotor is centrally located within a radially asymmetrical chamber, and accommodates chamber dimensional variations by vanes or pistons which periodically project from and retract into the rotor.

Pistons compress air on one side, and receive pressure from combustion gasses on the other side. Combustion is continuous, occurring in a dedicated combustion chamber. Sensors report data to a microprocessor, which controls fuel delivery to the combustion chamber.

U.S. Pat. No. 4,134,258, issued to Nobuhito Hobo et al. on Jan. 16, 1979, shows an electronic fuel metering system. Hobo et al. does not show an expander having a selectable expansion ratio.

U.S. Pat. No. 3,989,011, issued to Minoru Takahashi on Nov. 2, 1976, shows a heat engine having an air compressor, a combustion chamber, and an expansion chamber. Takahashi does not show an expander having a selectable expansion ratio.

U.S. Pat. No. 2,782,596, issued to Teodor I. Lindhagen et al. on Feb. 26, 1957, discloses an engine having an external combustion chamber and a positive displacement member.

U.S. Pat. No. 2,435,476, issued to Orran B. Summers on Feb. 3, 1948, shows a rotary internal combustion engine having a rotor with pivoted vanes. Summers does not show an expander having a selectable expansion ratio.

U.S. Pat. No. 2,382,259, issued to Fred H. Rohr on Aug. 14, 1945, shows a rotary combustion engine having sliding vanes. Rohr does not show an engine having a separate compressor and expander. Further, Rohr does not show an expander having a selectable expansion ratio.

U.S. Pat. No. 1,324,260, issued to Ralph J. Meyer on Dec. 9, 1919, shows a rotary pump with a rotor having pivoted vanes. Meyer does not show an expander having a selectable expansion ratio.

U.S. Pat. No. 1,138,481, issued to Friedrich Hupe on May 4, 1915, shows a rotary steam engine having a rotor with pivoted vanes. Hupe does not show an expander having a selectable expansion ratio.

U.S. Pat. No. 1,042,596, issued to William E. Pearson on Oct. 29, 1912, shows a liquid motor having a rotor with sliding vanes. Pearson does not relate to gas expanders at all, and does not show the selectable expansion ratio feature of the present invention.

German Pat. Document No. 40 23 299, dated Feb. 21, 1991, describes a continuous internal combustion engine having a rotor of configuration similar to that of a helical screw positive displacement pump.

German Pat. Document No. 1815711, dated Jun. 25, 1970, shows a heat engine having an air compressor, a combustion chamber, and an expansion chamber. German '711 has a sliding vane type expander with a single passive vacuum relief valve. German '711 does not show an expander whose expansion ratio can be selectively set at a plurality of values.

Japanese Pat. Document No. 56-113087, dated Sep. 5, 1981, shows a rotary pump or compressor with a rotor having pivoted vanes. Japanese '087 does not show an expander having a selectable expansion ratio.

Japanese Pat. Document No. 55-78188, dated Jun. 12, 1980, shows a rotary internal combustion engine having a rotor with pivoted vanes. Japanese '188 does not show an engine having a separate compressor and expander. Further, Japanese '188 does not show an expander having a selectable expansion ratio.

None of the above inventions and patents, taken either singly or in combination, is seen to describe the instant invention as claimed.

SUMMARY OF THE INVENTION

The present invention comprises a combustion engine having a combustion chamber, a compressor and an expander. Both compressor and expander are of the rotary vane type, and employ a common shaft.

In most prior art rotary vane expansion and compression devices, the vanes are biased, as by spring or fluid pressure, to contact the inner surface of the housing. This could lead to excessive friction, either between vane edge and housing, or between the vane and its supporting cavity walls, and further threatens to bind the vane against the housing.

This potentially harmful relation is obviated in the present invention by an arrangement wherein the vanes are controlled by arms having rollers. The rollers roll along a cam or track which is configured to cooperate with the housing cross sectional configuration. The rollers influence the arms, and therefore the vanes, to remain within a predetermined dimension of the housing wall.

If rapidly fluctuating conditions cause expansion such that pressure in the expander is dropped below ambient pressure, venting valves automatically open to enable atmospheric pressure to compensate for the vacuum.

The venting valves also provide variation of the dynamic expansion ratio. While the geometry of the rotor and housing are fixed, the mathematical expansion ratio is thus also fixed. Provision of the venting valves allows the expander geometry to be variable, thus allowing the expansion ratio to be set at a value selected from a plurality of values corresponding in number to the number of venting valves.

Lubrication and cooling are provided by the lubricant, which is slung under great force by centrifugal action, spreading through shaft bearings to the inside of the compressor and expander rotors. A microprocessor and sensor system control fuel supply, so that the engine quickly responds to changes in power demand. The same microprocessor controls the venting valves.

The compressor and expander are mounted to a common shaft and are of the positive displacement type. Therefore, air supply volume is linear with the volume being expanded. The novel heat engine is able, therefore, to cause the torque curve to be substantially linear, within minor limits imposed by high speed friction and fluid flow characteristics.

Because air is compressed separately from the fuel, the combustion process is resistant to suppression. The heat engine therefore operates satisfactorily at very low rotational speeds. Separate compression of air also causes less pollution to be produced during the combustion process, since peak temperatures are lower than would occur when fuel and air are compressed as a mixture, thus leading to a lower tendency for nitrogen oxides to form. Furthermore, air mixing is superior to that of other internal combustion engines, and the time allowed for combustion is not limited in the same manner as the time allotted to an Otto or Diesel cycle engine. For these reasons, fuel burns substantially to completion, and hydrocarbon and carbon monoxide emissions are substantially mitigated. Further, because air is compressed separately from the fuel, no knocking or autoignition problems exist with the heat engine of the present invention.

Accordingly, it is a principal object of the invention to provide a combustion engine of the rotary vane type.

It is another object of the invention to provide a rotary vane engine wherein frictional contact of the vanes with the rotor and housing is minimized.

It is a further object of the invention to control vanes by a guide, whereby vanes are not subject to contact with the rotor housing.

Still another object of the invention is to provide for venting an expansion chamber to the atmosphere, whereby excessive pressure drop during expansion is prevented from reducing engine output.

It is yet another object of the invention to provide a rotary vane engine wherein conditions favor complete combustion and wherein peak temperatures are limited.

It is again an object of the invention to provide a rotary vane engine capable of producing nearly maximum torque at low rotational speeds.

An additional object of the invention is to provide a rotary vane engine having a torque curve which is substantially linear throughout the range of attainable rotational speeds.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 4 is a diagrammatic, top plan, cross sectional view of the compressor and expander assemblies, showing details of the lubrication system of the present invention.

FIG. 5 is an elevational detail view of a representative vane arm, as used in the compressor and expander of the present invention, shown in isolation.

Similar reference characters denote corresponding features consistently throughout the attached drawings.

DETAILED DESCRIPTION OF THE PREFERRED EMBODIMENT

Figure 1:
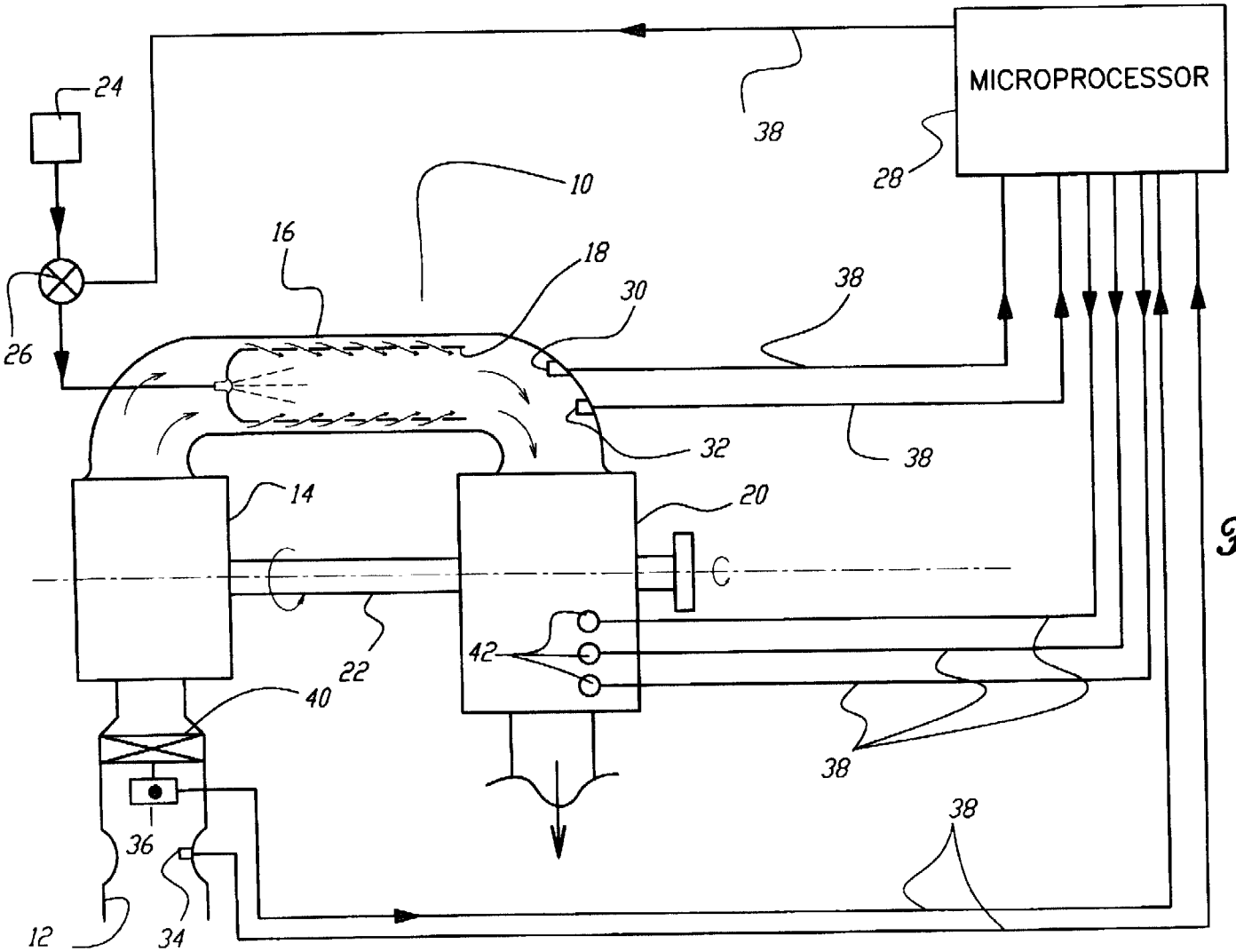
FIG. 1 is a schematic representation of the heat engine and associated control system of the present invention.

The heat engine 10 of the present invention is seen in diagrammatic form in FIG. 1. An air intake 12 communicating with the atmosphere or other suitable air source leads to a compressor assembly 14, which discharges compressed air to a combustor 16 having a combustion chamber 18. Hot gaseous products of combustion are conducted to an expander assembly 20. Compressor and expander assemblies 14,20 are mounted to a common shaft 22.

Figure 2:
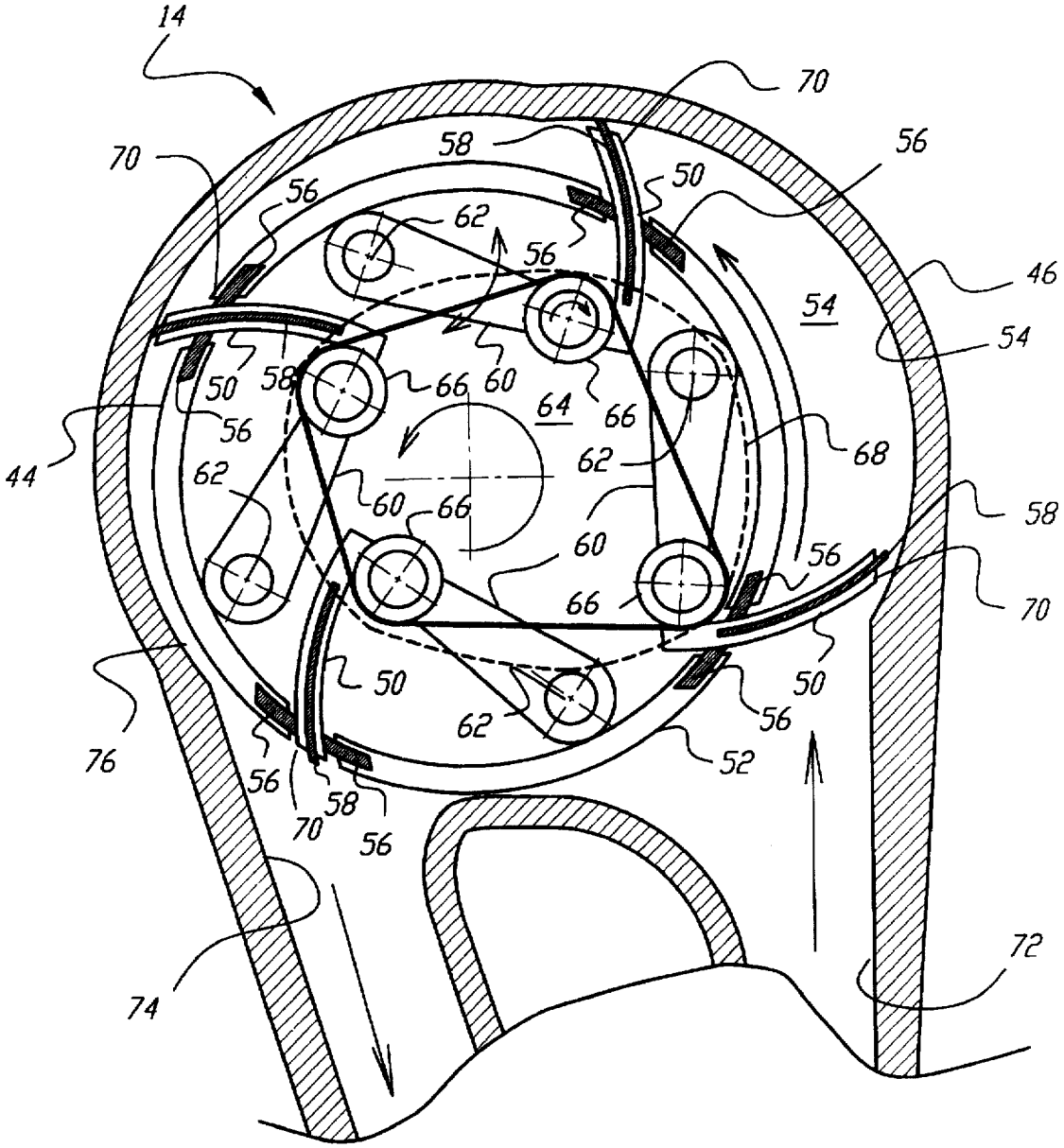
FIG. 2 is a cross sectional detail view of the compressor of the present invention.
Figure 3:
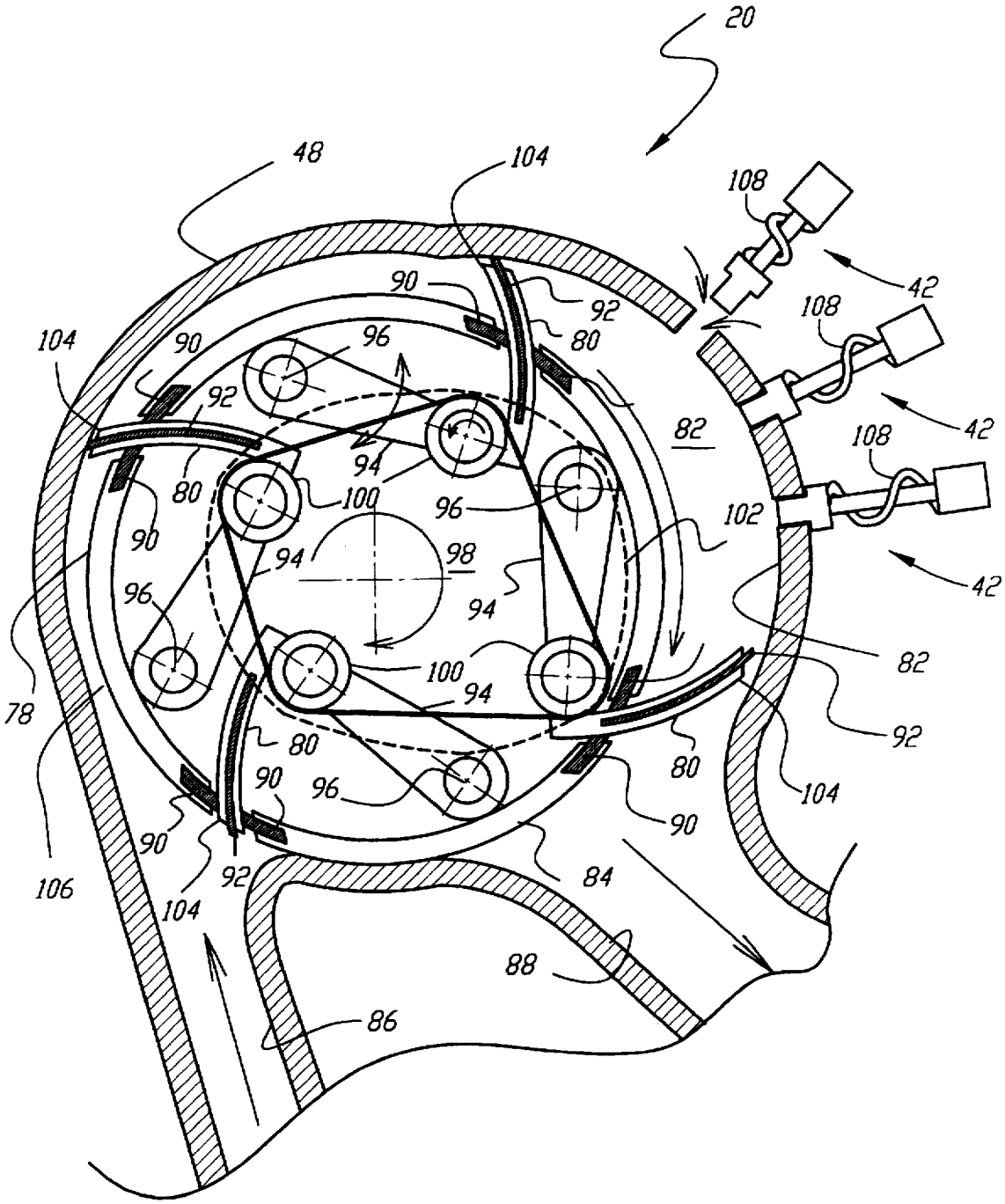
FIG. 3 is a cross sectional detail view of the expander of the present invention.

Turning now to FIGS. 2 and 3, the structures of compressor assembly 14 and the expander assembly 20 will be described. Compressor and expander assemblies 14,20 are essentially similar in configuration, although expander 20 has venting valves 42. the venting valves 42 will be discussed in greater detail in the context of the detailed description of the expander 20. The compressor 14 has a rotor 44 of circular cross section, mounted eccentrically, with respect to the center of mass of the cross sectional area of the interior of compressor housing 46, within compressor housing 46 and includes vanes 50 which project from the rotor 44. Housing interior surface 54 has a portion parallel to the surface 52 of the rotor 44 from which the vanes 50 project. This surface portion would be projecting out of the plane of the page in the view shown in FIG. 2. The portion of surface 54 parallel to surface 52, is displaced from the surface 52 by a variable amount. This displacement decreases monotonically from a maximum proximate the intake 72 to a minimum proximate the outlet 74. Variable projection enables vanes 50 to seal the displacement, i.e. the dimension, between rotor surface 52 and the portion of the housing interior surface 54 parallel to surface 52. The variable distance existing between rotor surface 52 and the portion of the housing interior surface 54 parallel to surface 52, arises from the eccentricity of rotor 44 with respect to the center of mass of the cross sectional area of the interior of housing 46. Accordingly, the projection of each of the vanes 50 varies monotonically between a maximum projection proximate intake 72 to a minimum projection proximate outlet 74. Thus the projection of each of the vanes 50 varies between a maximum and a minimum projection, and reaches the maximum projection once for every revolution of the rotor 44. The housing interior surface 54, in cross section, may form a modified "FIG.-8", wherein two circles overlap but do not precisely overlie one another. Of course, other cross sectional configurations, for example, circles and ellipses, would be satisfactory, depending upon the actual application. Additional seals 56,58 seal gaps existing between rotor 44 and vanes 50, and between vanes 50 and housing interior surface 54. The rotor 44 is generally cylindrical, and is mounted on shaft 22, which is coaxial therewith. In the preferred embodiment of FIG. 1, shaft 22 is common to both the compressor rotor and the expander rotor. Returning to rotor construction, as illustrated in FIG. 2, each vane 50 is secured at one end to an arm 60, which arm 60 is pivotally attached to rotor 44 about axis 62. Arm 60 is mounted on an end wall 64 of cylindrical rotor 44, and extends into the hollow interior of rotor 44, in order to movably support vane 50 so as to allow vane 50 to move into and out of rotor 44. Vane 50 is preferably arcuate about a radius swung about axis 62, to accommodate projection and retraction. Arm 60 oscillates as rotor 44 rotates, being guided by the following arrangement.

A rotatable guide bearing 66 is disposed upon arm 60. Guide bearing 66 is located on the opposite side of arm 60 from end wall 64. A groove or track 68 is formed in a housing end wall (not shown), and guide bearing 66 rolls just inside track 68. As depicted in dotted line in the diagrammatic rendition of FIG. 2, track 68 acts as a camming surface controlling the amount of projection of vanes 50 out of the rotor 44. As the rotor 44 rotates the guide bearing 66 travels along track 68. The track 68 passes close to the surface 52 near the intake 72 and farther from the surface 52, and closer to the center of rotor 44, near the outlet 74. Therefore, as the rotor 44 rotates, the guide bearings 66 move close to and away from surface 52, correspondingly causing respective vanes 50 to project a greater amount, near intake 72, and a lesser amount, near outlet 74, from the surface 52.

Track 68 is configured to cooperate with or parallel the portion, parallel to surface 52, of interior surface 54 of housing 46, in the sense that a tip 70 of vane 50 is maintained spaced from the portion, parallel to surface 52, of interior surface 54 by a gap of predetermined dimension. This is an important feature of the invention, since vanes 50 are not subject to frictional contact with interior surface 54, nor with walls which would otherwise be required to support and guide vanes 50 within rotor 44. The possibility of a vane 50 binding against interior surface 54 is thereby forestalled.

Guide bearing 66 can be maintained in contact with track 68 by centrifugal force or by springs (not shown) biasing vanes 50 to project from surface 52 of rotor 44. It should be noted that many other means, for maintaining guide bearing 66 in contact with track 68, will readily be apparent to those skilled in the art and all such means are considered to be within the scope of the present invention.

An arm 60 and a vane 50 are shown isolated from other components in the detail of FIG. 5. Pivot about axis 62, and arcuate nature of vane 50 are clearly shown. Compressor 14 has inlet 72 and outlet 74 which define the inlet channel and the outlet channel of the compressor respectively. Compressor assembly 14 draws in fresh air, and compresses the same, releasing compressed air at a point of minimal expansible chamber volume 76, to the outlet 74.

Referring to FIG. 3, the expander 20 is seen. The expander 20 has a rotor 78 of circular cross section, mounted eccentrically, with respect to the center of mass of the cross sectional area of the interior of expander housing 48, within expander housing 48, and includes vanes 80 which project from the rotor 78. Housing interior surface 82 has a portion parallel to the surface 84 of the rotor 78 from which the vanes 80 project. This surface portion would be projecting out of the plane of the page in the view shown in FIG. 3. The portion of surface 82 parallel to surface 84, is displaced from the surface 84 by a variable amount. This displacement increases monotonically from a minimum proximate the intake 86 to a maximum proximate the outlet 88. Variable projection enables vanes 80 to seal the displacement, i.e. the dimension, between rotor surface 84 and the portion of the housing interior surface 82 parallel to surface 84. The variable distance existing between rotor surface 84 and the portion of the housing interior surface 82 parallel to surface 84, arises from the eccentricity of rotor 78 with respect to the center of mass of the cross sectional area of the interior of housing 48. Accordingly, the projection of each of the vanes 80 varies monotonically between a minimum projection proximate intake 86 to a maximum projection proximate outlet 88. Thus each of vanes 80 reaches the maximum projection once for every revolution of the rotor 78. The housing interior surface 82, in cross section, may form a modified "figure-8", wherein two circles overlap but do not precisely overlie one another. Of course, other cross sectional configurations, for example, circles and ellipses, would be satisfactory, depending upon the actual application. Additional seals 90,92 seal gaps existing between rotor 78 and vanes 80, and between vanes 80 and housing interior surface 82.

The rotor 78 is generally cylindrical, and is mounted on shaft 22, which is coaxial therewith. As was noted previously, shaft 22 is common to both rotors 44 and 78. Returning to rotor construction, as illustrated in FIG. 3, each vane 80 is secured at one end to an arm 94, which arm 94 is pivotally attached to rotor 78 about axis 96. Arm 94 is mounted on an end wall 98 of cylindrical rotor 78, and extends into the hollow interior of rotor 78, in order to movably support vane 80 so as to allow vane 80 to move into and out of rotor 78. Vane 80 is preferably arcuate about a radius swung about axis 96, to accommodate projection and retraction. Arm 94 oscillates as rotor 78 rotates, being guided by the following arrangement.

A rotatable guide bearing 100 is disposed upon arm 94. Guide bearing 100 is located on the opposite side of arm 94 from end wall 98. A groove or track 102 is formed in a housing end wall (not shown), and guide bearing 100 rolls just inside track 102. As depicted in dotted line in the diagrammatic rendition of FIG. 3, track 102 acts as a camming surface controlling the amount of projection of vanes 80 out of the rotor 78. As the rotor 78 rotates the guide bearing 100 travels along track 102. The track 102 passes close to the surface 84 near the outlet 88 and farther from the surface 84, and closer to the center of rotor 78, near the inlet 86. Therefore, as the rotor 78 rotates, the guide bearings 100 move close to and away from surface 84, correspondingly causing respective vanes 80 to project a greater amount, near outlet 88, and a lesser amount, near inlet 86, from the surface 84.

Track 102 is configured to cooperate with or parallel the portion, parallel to surface 84, of interior surface 82 of housing 48, in the sense that a tip 104 of vane 80 is maintained spaced from the portion, parallel to surface 84, of interior surface 82 by a gap of predetermined dimension. This is an important feature of the invention, since vanes 80 are not subject to frictional contact with interior surface 82, nor with walls which would otherwise be required to support and guide vanes 80 within rotor 78. The possibility of a vane 80 binding against interior surface 82 is thereby forestalled.

Guide bearing 100 can be maintained in contact with track 102 by centrifugal force or by springs (not shown) biasing vanes 80 to project from surface 84 of rotor 78. It should be noted that many other means, for maintaining guide bearing 100 in contact with track 102, will readily be apparent to those skilled in the art and all such means are considered to be within the scope of the present invention.

The arm 94 and the respective vane 80 are identical in their general configuration to arm 60 and respective vane 50 shown in isolation in the detail of FIG. 5. Pivoting of arm 94 about axis 96 and the arcuate nature of vane 80, would be identical to the pivoting of arm 60 about axis 62 and the arcuate nature of vane 50 as shown in FIG. 5.

It will be appreciated that expander 20 is substantially similar to compressor 14, however expander 20 operates in reverse sequence to compressor 14. Expander assembly 20 accepts heated combustion gasses within its inlet 86, which gasses are then introduced to a variable volume space defined by surface 84, surface 82, and a neighboring pair of vanes 80, at a point 106. The variable volume space defined by surface 84, surface 82, and a neighboring pair of vanes 80, occupies its minimum volume at the point 106. As rotor 78 rotates, this variable volume space expands, heat energy is converted to mechanical energy, and exhaust is discharged to an exhaust system (not shown in its entirety) through outlet 88.

The principal structural difference between compressor and expander assemblies 14 and 20 is the presence in the latter of the plurality of valves 42. Valves 42 are actively controlled which means that the valves 42 can be set in either the open position or the closed position independently of the pressure differential existing across any particular valve 42. Valves 42 are preferably electromagnetically operated, for example by using solenoids, and are biased into the closed position by springs 108. Alternatively, valves 42 may be mechanically actuated as, for example, by a cam arrangement, or the valves 42 may be actuated hydraulically using a hydraulic cylinder. Regardless of the actuating mechanism, most preferably the valves 42 are actively controlled by a microprocessor which selectively opens valves 42 in response to sensor inputs which will be described below. The valves 42 in the rotary expansible chamber device housing 48 are provided to admit atmospheric air to the housing when the pressure in the housing drops below atmospheric pressure. During the expansion of a gas if the pressure in the rotary expansible chamber device housing drops below atmospheric, the rotor will have to do work to discharge the gas to the atmosphere thus losing efficiency. Opening the valves 42, effectively reduces the expansion ratio of the rotary expansible chamber device 20 of the present invention, thereby preventing the pressure inside the housing from falling below atmospheric pressure.

In the illustrated example, provision of three valves 42 effectively allows the expander 20 to have four actively selectable expansion ratios. With all three valves 42 closed, the expander has its highest expansion ratio. Opening the valve closest to the outlet 88 of the expander, reduces the expansion ratio to the next lower level. Simultaneously opening the two valves closest to the outlet of the expander, further reduces the expansion ratio to the second lowest level. Finally, opening all three valves reduces the expansion ratio of the expander 20 to its lowest value.

In addition to opening valves 42 in response to low pressure in the expander housing, the valves 42 may be opened in response to a drop in demand for power as detected by sensor 36 which will be described below. Opening valves 42 reduces power output by the expander. This in turn reduces power available to the compressor 14 causing a decrease in the air intake flow rate. Reduced air flow means that less power will be generated from combustion, which leads to an overall reduction in engine rpm. Thus opening valves 42 can effectively act as an engine control mechanism allowing quick braking of the engine.

Fuel is conducted from a fuel storage tank 24 to combustor 16. Fuel flow is controlled by a valve 26. A microprocessor 28 processes input data generated by sensors, and adjusts fuel valve 26 accordingly.

There are four principal sensors 30,32,34,36. Sensors 30 and 32 sense temperature and pressure, respectively, existing at the outlet of the combustion chamber 18. Air flow sensor 34, located in the airstream of air intake 12, determines rate of intake of air mass, generating appropriate signals which are communicated to microprocessor 28 by communication cables, generally designated 38. Air flow sensor 34 is of any suitable common type currently in use in automotive applications, and need not be described in greater detail herein. Demand for power is inferred by demand sensor 36, which senses an operator control 40 essentially corresponding to a throttle.

In response to these inputs, microprocessor 28 generates four control signals. One control signal modulates fuel valve 26 to suit conditions. Temperature and pressure sensors 30,32 indicate excessive or intolerable temperature or pressure, or failure of combustion. Fuel valve 26 is adjusted accordingly. Demand for power is the most significant variable influencing fuel flow under normal circumstances.

Air flow sensor 34 provides one input to microprocessor 28 enabling, in combination with other inputs, inferred determination of a low pressure condition which may exist within expander assembly 20.

The pressure within the expander housing can be inferred using well known thermodynamic principles given the pressure and temperature measured by sensors 32 and 30 (see FIG. 1) respectively.

The fundamental relationships used to evaluate the pressure in the expander housing are, $$PV^{\gamma}=\text{constant} \quad (1)$$

$$PV=nRT_g \quad (2)$$

$$Q=Ah(T_g-T_h) \quad (3)$$

$$Q=C_p\Delta T_g \quad (4)$$

Where P is pressure of the gas in the expander, V is volume of the gas in the expander, n is the moles of gas, R is the gas constant, $T_g$ is the gas temperature, $T_h$ is the housing wall temperature, $\gamma=C_p/C_v$, $C_p$ is the constant pressure heat capacity of the gas, $C_v$ is the constant volume heat capacity of the gas, Q is the heat loss from the gas, A is the heat transfer area, and h is the heat transfer coefficient. These relationships can be found in any introductory text on thermodynamics. Using a well known numerical technique known as zero dimension analysis, one of ordinary skill in the mechanical engineering art could calculate the gas pressure and temperature at any point in the expander housing given the inlet temperature and pressure, and the air flow rate.

The calculation would begin by calculating the gas pressure after a small increment of time using equation 1. The heat capacity ratio $\gamma$ is a function of temperature and can be calculated using readily available software. Because in engines of the present type the ratio of air to fuel is on the order of 50 to 1, the gas composition is assumed to be the same as air. Using the air flow rate and the expansion ratio of the expander, which is determined by the expander geometry, the engine rpm can be determined. The volume of an elemental volume of the gas at the beginning and the end of the time interval is determined by the expander geometry and the engine rpm. Using equation 1 the pressure at the end of the time interval can be calculated.

Given the pressure and volume at the end of the time interval, a new temperature for the gas can be calculated using equation 2. An average of the new temperature and the initial temperature is used in equation 3 to calculate the heat loss from the gas during the time interval. The heat transfer coefficient h is given in the literature as a function of surface type and Reynolds number.

Using the heat loss calculated above and equation 4, a corrected gas temperature can be calculated. Again, using equation 2 and the corrected temperature a corrected pressure is calculated. The heat capacity ratio $\gamma$ is evaluated at the corrected temperature, and the whole process is repeated for additional increments of time.

The above process is continued until the sum of the increments of time equals the time that is required for the elemental volume of gas to move from the expander inlet to the location of the vent valves. This numerical technique can be readily implemented using a microprocessor by one of ordinary skill in the art, and the thermodynamic analysis used would also be within the level of ordinary skill in the art.

Alternatively, experimental correlations correlating the pressure in the expander housing with the pressure measured by sensor 32, the temperature measured by sensor 30, and the air flow measured by sensor 34, may be programmed into the microprocessor 28 allowing the microprocessor to determine the pressure in the expander housing at the location of the valves 42. The correlations can be determined by routine experimentation using an experimental engine having a pressure sensor provided proximate the location of each of the valves 42, for directly measuring the pressure in the expander housing in the vicinity of each of the valves 42. In addition, production engines may be provided with pressure sensors proximate the location of each of the valves 42, for directly measuring the pressure in the expander housing in the vicinity of each of the valves 42. Thus allowing microprocessor 28 to selectively open valves 42 in response to direct measurement of the pressure in expander housing 48 at the location of each of the valves 42.

In the embodiment shown herein, three signals control three venting valves 42 communicating between an expansion chamber (see FIG. 3) and the open atmosphere, should microprocessor 28 determine a low pressure condition wherein expansion drops pressure therein below ambient pressure. This provides another adjustment in response to low pressure, should conditions not warrant adjusting fuel flow.

Lubrication and cooling are provided by forced liquid lubrication, as seen in FIG. 4. Liquid lubricant, such as oil, is stored in an enclosure 110. A conduit 112 leads to an annulus 114 formed between shaft 22 and a shaft housing 116 enclosing shaft 22. Annulus 114 is extended to both ends of shaft 22, and communicates with the cavities 118 and 120, formed by rotors 44 and 78 respectively, via bores 122. Oil is constrained to flow through bores 122 by seals 124. Suitable bearings 126 are located in annulus 114, and are lubricated by oil flow therethrough. A flow path at 128 is then provided by vanes, conduits, or other suitable structure (none shown), so that flow path 128 extends radially outwardly towards circumferential walls 130 and 132 bounding rotors 44 and 78 respectively. When shaft 22 rotates, considerable centrifugal force is imparted to a liquid present in flow path 128. Thus, oil is pressurized, and subsequently completes the circuit being described.

The oil, pressurized by centrifugal force, continues to flow through passageways 134 and 136 into annular cavities 138 and 140 surrounding housings 46 and 48 respectively. The oil then flows back to storage enclosure 110 via conduits 142 and 144. Storage enclosure 110 is located above the level of shaft 22, and preferably above the highest point of flow path 128, so that there is always oil subject to be pressurized immediately upon shaft rotation.

As clearly seen in this circuit, oil flows through rotors 44 and 78 and around housings 46,48, thus contacting the major structures that require cooling. Heat may be dissipated from oil as by radiation from enclosure 110, or there may be provided an active heat exchange system (not shown), depending upon the application and cooling load encountered thereby.

While the best mode of realizing the invention is considered to be the embodiment wherein two rotors 44,78 and housings 46,48 are spaced apart, employing a common shaft 22, the rotors 44,78 and housing assemblies 46,48 could obviously be employed in other arrangements.

It is to be understood that the present invention is not limited to the sole embodiment described above, but encompasses any and all embodiments within the scope of the following claims.

I claim:

1. A rotary expansible chamber device, comprising:

a housing having an open interior, an interior surface, an inlet, and an outlet, said housing having a plurality of valve openings communicating between said housing open interior and the atmosphere, said plurality of valve openings being distributed between said inlet and said outlet in order of increasing distance from said outlet with a first one of said plurality of valve openings being positioned closest to said outlet relative to others of said plurality of valve openings, and each subsequent one of said plurality of valve openings being positioned farther from said outlet than a previous one of said plurality of valve openings in said order;

a plurality of valves provided for each of said plurality of valve openings, each of said plurality of valves being selectively movable between a closed and an open position, each of said plurality of valves obstructing fluid communication through a respective one of said plurality of valve openings when in said closed position, and enabling fluid communication through said respective one of said plurality of valve openings when in said open position;

a shaft rotatably supported in said housing, said shaft having an axis of rotation; and a rotor mounted within said housing and on said shaft, and having a longitudinal dimension disposed within said open interior, said rotor having a plurality of vanes supported therein, said vanes being disposed selectively to move to and from a retracted condition and an extended condition, said vanes sealing a gap existing between said housing interior surface and said rotor, the gap extending along said rotor longitudinal dimension, there being one arm for each said vane, each said arm pivotally mounted on said rotor about a pivot axis and controlling a respective said vane to move to the retracted and extended conditions, each said arm having guide bearing means rotatably projecting therefrom and extending from said rotor, said housing further having track means defining a guiding surface cooperating with said housing interior, said guide bearing means contacting and being guided by said guiding surface, said arms constraining said vanes to project, responsive to said guiding surface, from said rotor for a predetermined dimension between said rotor and said housing interior surface, said rotary expansible chamber device having an expansion ratio, and said expansion ratio being setable at a selected one of a plurality of expansion ratio values by opening respective ones of said plurality of valves.

2. The rotary expansible chamber device according to claim 1, said vanes being arcuate about a radius from said arm pivot axis.

3. The rotary expansible chamber device according to claim 1, said housing interior surface having a cross sectional configuration having a perimeter formed by two overlapping circles having different center points.

4. The rotary expansible chamber device according to claim 1, wherein said plurality of valves are electromagnetically operated.

5. The rotary expansible chamber device according to claim 1, said rotor further including means defining a space radially distant from said shaft axis of rotation, there further being:

a shaft housing enclosing said shaft, there being an annulus between said shaft and said shaft housing;

a storage enclosure for containing liquid lubricant disposed above said shaft;

a conduit for conducting liquid lubricant from said storage enclosure to said annulus; and means conducting liquid lubricant from said annulus to said radially located space, and restricting liquid lubricant against escape therefrom.

6. The rotary expansible chamber device according to claim 1, wherein each of said plurality of vanes projects from said rotor between a minimum distance and a maximum distance, and each of said plurality of vanes reaches said maximum distance, for projection from said rotor, once for every revolution of said rotor.

7. The rotary expansible chamber device according to claim 4, wherein each of said plurality of vanes projects from said rotor between a minimum distance and a maximum distance, and each of said plurality of vanes reaches said maximum distance, for projection from said rotor, once for every revolution of said rotor.

8. The rotary expansible chamber device according to claim 7, said housing interior surface having a cross sectional configuration having a perimeter formed by two overlapping circles having different center points.

9. A heat engine comprising:

a first rotary expansible chamber device having a first inlet communicating with an air source and a first outlet, said first rotary expansible chamber device including a first housing having a first open interior and an interior surface, a first rotor provided within said first housing and having a longitudinal dimension disposed within said first open interior, said first rotor having a first plurality of vanes supported therein, said first plurality of vanes being disposed selectively to move to and from a retracted condition and an extended condition, each of said first plurality of vanes sealing a gap existing between said first housing interior surface and said first rotor, the gap extending along said first rotor longitudinal dimension, said first plurality of vanes being supported by a first plurality of arms, there being one of said first plurality of arms for each of said first plurality of vanes, each of said first plurality of arms pivotally mounted on said first rotor about a pivot axis and controlling a respective one of said first plurality of vanes to move to the retracted and extended conditions, each of said first plurality of arms having a first guide bearing means rotatably projecting therefrom and extending from said first rotor, said first housing further having a first track means defining a first guiding surface cooperating with said first open interior, said first guide bearing means contacting and being guided by said first guiding surface, said first plurality of arms constraining said first plurality of vanes to project, responsive to said first guiding surface, from said first rotor for a predetermined dimension between said first rotor and said first housing interior surface;

a combustion chamber having a second inlet and a second outlet, said second inlet of said combustion chamber communicating with said first outlet of said first rotary expansible chamber device;

a second rotary expansible chamber device having a third inlet and a third outlet, said second outlet of said combustion chamber communicating with said third inlet of said second rotary expansible chamber device, said second rotary expansible chamber device including a second housing having a second open interior and an interior surface, said second housing having a plurality of valve openings communicating between said second open interior and the atmosphere, said plurality of valve openings being distributed between said third inlet and said third outlet in order of increasing distance from said third outlet with a first one of said plurality of valve openings being positioned closest to said third outlet relative to others of said plurality of valve openings, and each subsequent one of said plurality of valve openings being positioned farther from said third outlet than a previous one of said plurality of valve openings in said order, a plurality of valves provided for each of said plurality of valve openings, each of said plurality of valves being selectively movable between a closed and an open position, each of said plurality of valves obstructing fluid communication through a respective one of said plurality of valve openings when in said closed position, and enabling fluid communication through said respective one of said plurality of valve openings when in said open position, a second rotor provided within said second housing and having a longitudinal dimension disposed within said second open interior, said second rotor having a second plurality of vanes supported therein, said second plurality of vanes being disposed selectively to move to and from a retracted condition and an extended condition, each of said second plurality of vanes sealing a gap existing between said second housing interior surface and said second rotor, the gap extending along said second rotor longitudinal dimension, said second plurality of vanes being supported by a second plurality of arms, there being one of said second plurality of arms for each of said second plurality of vanes, each of said second plurality of arms pivotally mounted on said second rotor about a pivot axis and controlling a respective one of said second plurality of vanes to move to the retracted and extended conditions, each of said second plurality of arms having a second guide bearing means rotatably projecting therefrom and extending from said second rotor, said second housing further having a second track means defining a second guiding surface cooperating with said second open interior, said second guide bearing means contacting and being guided by said second guiding surface, said second plurality of arms constraining said second plurality of vanes to project, responsive to said second guiding surface, from said second rotor for a predetermined dimension between said second rotor and said second housing interior surface; and a common shaft having an axis of rotation and rotatably supported by said first housing and said second housing, respective said first and second rotors of each said first and second rotary expansible chamber devices being mounted on said common shaft, whereby air is compressed in said first rotary expansible chamber device, is delivered to and supports combustion in said combustion chamber, and products of combustion are conducted to and expanded within said second rotary expansible chamber device, thereby yielding useful energy in rotary form, said second rotary expansible chamber device having an expansion ratio, and said expansion ratio being setable at a selected one of a plurality of expansion ratio values by opening respective ones of said plurality of valves.

10. The heat engine according to claim 9, wherein said plurality of valves are electromagnetically operated.

11. The heat engine according to claim 9, wherein each of said first plurality of vanes projects from said first rotor between a first minimum distance and a first maximum distance, and each of said first plurality of vanes reaches said first maximum distance, for projection from said first rotor, once for every revolution of said first rotor, and wherein each of said second plurality of vanes projects from said second rotor between a second minimum distance and a second maximum distance, and each of said second plurality of vanes reaches said second maximum distance, for projection from said second rotor, once for every revolution of said second rotor.

12. The heat engine according to claim 11, further including a fuel supply conducting a fuel to said combustion chamber, a fuel valve controlling said fuel supply, a demand sensor sensing demand for power and generating a control signal, and a microprocessor controlling said fuel valve responsive to said control signal.

13. The heat engine according to claim 12, further including a temperature sensor sensing temperature at said second outlet of said combustion chamber and generating a temperature signal, and said microprocessor reducing fuel supply to said combustion chamber when said temperature signal indicates a temperature value exceeding a predetermined temperature value.

14. The heat engine according to claim 12, further including a pressure sensor sensing pressure at said second outlet of said combustion chamber and generating a pressure signal, and said microprocessor reducing fuel supply to said combustion chamber when said pressure signal indicates a pressure value exceeding a predetermined pressure value.

15. The heat engine according to claim 9, said first rotor including means defining a first space radially distant from said common shaft axis of rotation and said second rotor including means defining a second space radially distant from said common shaft axis of rotation, there further being:

a shaft housing enclosing said common shaft, there being an annulus between said shaft and said shaft housing;

a storage enclosure for containing liquid lubricant disposed above said common shaft;

a conduit for conducting liquid lubricant from said storage enclosure to said annulus; and means conducting liquid lubricant from said annulus to said first space and said second space, and restricting liquid lubricant against escape therefrom.

16. The heat engine according to claim 9, said first housing interior surface having a cross sectional configuration having a perimeter formed by first and second overlapping circles having different center points, and said second housing interior surface having a cross sectional configuration having a perimeter formed by third and fourth overlapping circles having different center points.

17. The heat engine according to claim 10, further including a fuel supply conducting a fuel to said combustion chamber, a fuel valve controlling said fuel supply, a demand sensor sensing demand for power and generating a control signal, a microprocessor controlling said fuel valve responsive to said control signal, and a temperature sensor sensing temperature at said second outlet of said combustion chamber and generating a temperature signal, said microprocessor reducing fuel supply to said combustion chamber when said temperature signal indicates a temperature value exceeding a predetermined temperature value.

18. The heat engine according to claim 17, further including a pressure sensor sensing pressure at said second outlet of said combustion chamber and generating a pressure signal, and said microprocessor reducing fuel supply to said combustion chamber when said pressure signal indicates a pressure value exceeding a predetermined pressure value.

19. A heat engine comprising:

a first rotary expansible chamber device having a first inlet communicating with an air source and a first outlet, said first rotary expansible chamber device including a first housing having a first open interior and an interior surface, a first rotor provided within said first housing and having a longitudinal dimension disposed within said first open interior, said first rotor having a first plurality of vanes supported therein, said first plurality of vanes being disposed to move to and from a retracted condition and an extended condition, each of said first plurality of vanes sealing a gap existing between said first housing interior surface and said first rotor, the gap extending along said first rotor longitudinal dimension;

a combustion chamber having a second inlet and a second outlet, said second inlet of said combustion chamber communicating with said first outlet of said first rotary expansible chamber device;

a second rotary expansible chamber device having a third inlet and a third outlet, said second outlet of said combustion chamber communicating with said third inlet of said second rotary expansible chamber device, said second rotary expansible chamber device including a second housing having a second open interior and an interior surface, a second rotor provided within said second housing and having a longitudinal dimension disposed within said second open interior, said second rotor having a second plurality of vanes supported therein, said second plurality of vanes being disposed to move to and from a retracted condition and an extended condition, each of said second plurality of vanes sealing a gap existing between said second housing interior surface and said second rotor, the gap extending along said second rotor longitudinal dimension, said second housing further including at least one valve opening communicating between said second open interior of said second housing and the atmosphere, and one valve for each of said at least one valve opening, each said valve being electromagnetically operated and being selectively movable with respect to said at least one valve opening so as to obstruct and enable communication between said second open interior of said second housing and the atmosphere, and each said valve being selectively opened when a low pressure condition exists within said second rotary expansible chamber device, whereby said low pressure condition is relieved by atmospheric pressure; and a common shaft having an axis of rotation and rotatably supported by said first housing and said second housing, respective said first and second rotors of each said first and second rotary expansible chamber devices being mounted on said common shaft, whereby air is compressed in said first rotary expansible chamber device, is delivered to and supports combustion in said combustion chamber, and products of combustion are conducted to and expanded within said second rotary expansible chamber device, thereby yielding useful energy in rotary form.

* * * * *